United States Patent [19]

Durner

[11] Patent Number: 4,643,613

[45] Date of Patent: Feb. 17, 1987

[54] UNDERWATER TRENCHING AND PIPE-LAYING DEVICES

[75] Inventor: Yvan Durner, Paris, France

[73] Assignee: Mali S.A.R.L., Paris, France

[21] Appl. No.: 718,344

[22] Filed: Apr. 1, 1985

[30] Foreign Application Priority Data

Apr. 2, 1984 [FR] France ..... 84 05165

[51] Int. Cl.[4] ..... F16L 1/04; E02F 5/10

[52] U.S. Cl. ..... 405/161; 405/164

[58] Field of Search ..... 405/159–165, 405/174, 180, 183; 37/80 A

[56] References Cited

U.S. PATENT DOCUMENTS

| | | | |
|---|---|---|---|
| 2,067,717 | 1/1937 | Lawton et al. | 405/164 |
| 3,238,734 | 3/1966 | Rhodes | 405/159 |
| 3,504,504 | 4/1970 | Elliott | 405/163 |
| 3,540,226 | 11/1970 | Sherrod | 405/164 |
| 4,091,629 | 5/1978 | Gunn et al. | 405/163 X |
| 4,301,606 | 11/1981 | Hofmeester | 405/163 X |

*Primary Examiner*—David H. Corbin

*Attorney, Agent, or Firm*—Larson & Taylor

[57] ABSTRACT

For burying piping (1) in a sea-bed, at least one excavating machine (3) is provided for forming a first trench (4) parallel to the front portion ($1_1$) of the piping and to a guide formwork (5) adapted both for moving parallel to the first trench (4) and for then forming automatically, during its horizontal advance, a second trench (8) parallel to this first trench, contiguous therewith and extending planewise in the extension of the front piping portion, said structure having for this purpose an oblique front moldboard (9) which pushes back laterally into the first trench the earth engaged thereby and for automatically burying the piping (1) in the second trench (8) thus formed.

6 Claims, 7 Drawing Figures

FIG.1.
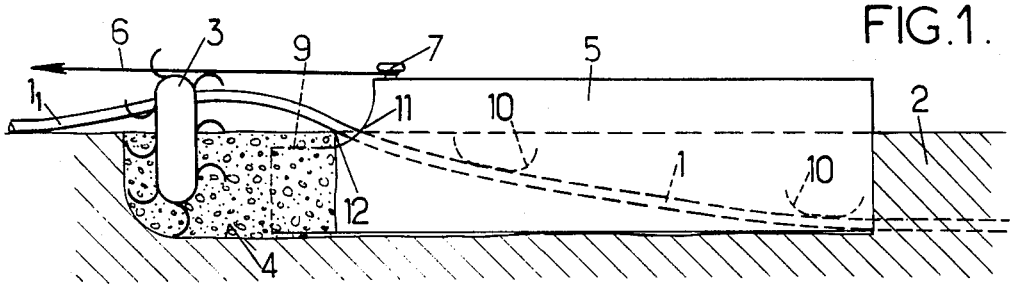
FIG.2.
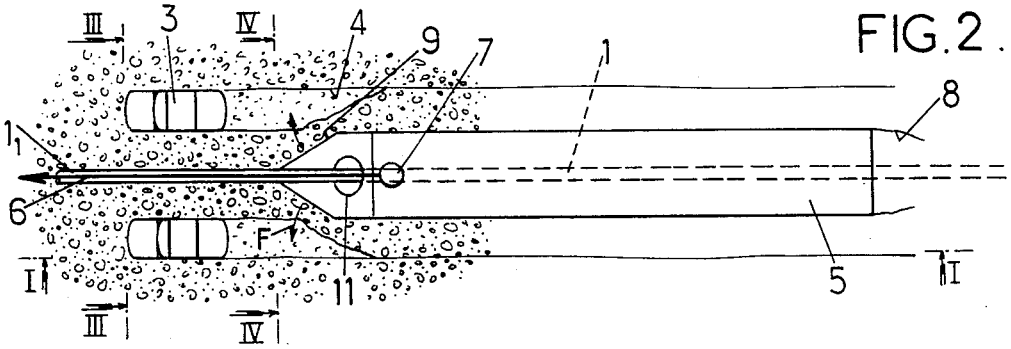
FIG.3.
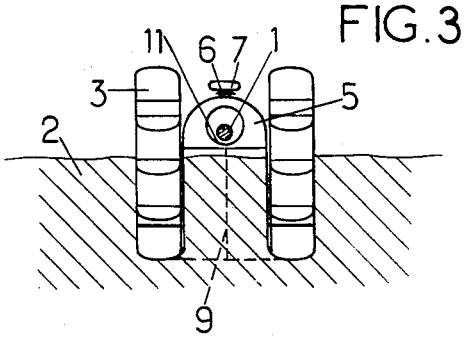
FIG.4.
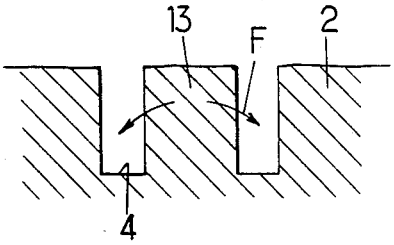
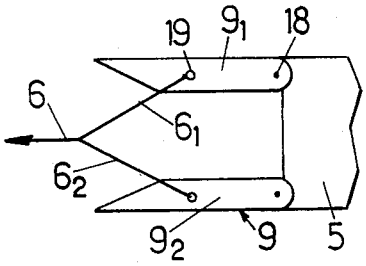
FIG.6.
FIG.5.
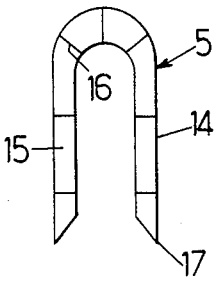
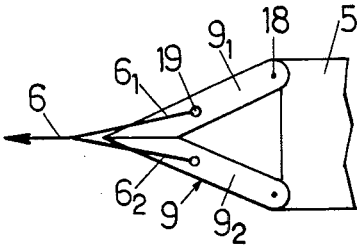
FIG.7.

UNDERWATER TRENCHING AND PIPE-LAYING DEVICES

The invention relates to underwater trenching and pipe-laying processes and devices, i.e. for forming a trench in a seabed and burying piping therein which is in general laid beforehand on this bed.

In the present description, for the sake of simplicity, the following expressions will be adopted in a way which is of course in no wise limitative:

- the expression "sea" . . . for designating the masses of water at the bottom of which it is desired to carry out trenching and pipe-laying work, these masses being formed not only by seas properly speaking but also by other comparable masses of water such as lakes or rivers,
- and the expression "piping" or "pipe" for designating the continuous elements to be laid and buried, these elements being not only of the solid kind (electric cables) but also hollow (pressurized fluid conduits for gas, oil etc...).

In some known constructions, the trenching and pipe-laying devices comprise, hitched to a common tractor adapted for moving over the sea-bed, first of all an excavating machine adapted for forming the trench or "ditch" then, just behind this machine a guide structure towed inside the trench excavated by said machine, said structure being adapted for automatically guiding and burying the piping at the bottom of the trench simply through its advancing motion with respect to this piping.

These trenching and pipe-laying devices have certain disadvantages and in particular the following:

- since the active portion of the excavating machine is necessarily offset in a plane with respect to a front portion of the piping previously laid on the sea-bed, the same goes for the trench excavated by the machine and said piping must then be formed into an S behind said machine for burying it in said trench, which excludes the laying of insufficiently flexible piping such as certain metal pipes,
- the relative positions of the excavating machine and of the guide structure are invariable and their advancing speeds along the sea-bed are identical, whatever the resistance or local hardness of this bed, which in particular excludes any backward movement of the excavating machine for, if required, complementary removal of material in contact with the guide structure for unjamming this latter which may have become jammed by lateral thrusts of the walls of the trench.

The aim of the invention, among others, is to overcome these drawbacks by proposing for trenching and pipe-laying a particularly efficient and energy saving method, lending itself in particular to the handling of relatively rigid piping.

For this, the trenching and pipe-laying processes of the invention further comprise the excavation of a trench extending parallel to the front portion of the piping to be buried and offset in a plane with respect to this portion and, on the other hand, the automatic burying of the piping by means of a guide structure advancing horizontally with respect to this piping and they are characterized in that a second trench is excavated parallel to the above trench or "first trench", contiguous with this first trench and extending planwise in the extension of said front piping portion, the material removed for forming this second trench being pushed laterally into said first trench by an oblique moldboard provided at the front of the guide structure and in that said piping is buried in this second trench by means of said structure.

As for the trenching and pipe-laying devices of the invention, they further comprise, like those described above, an excavating machine for forming a trench extending parallel to the front portion of the piping to be buried and offset in a plane with respect to this portion, as well as a guide structure for automatically laying and burying the piping and they are characterized in that said guide structure is adapted on the one hand for moving parallel to the above trench or "first trench" and then forming automatically, during its horizontal advance, a second trench parallel to said first trench, contiguous therewith and extending in a plane in the extension of said front piping portion, said structure comprising for this an oblique forward moldboard which pushes laterally into the first trench the earth which it engages and, on the other hand, for laying and burying the piping in the second trench thus formed.

In preferred embodiments, recourse is further had to one/or the other of the following arrangements,

- the excavating machine is disposed fairly close to the moldboard so as to discharge not only the material removed for forming the first trench but also a part of the material pushed towards this first trench by the guide structure,
- the means for causing the horizontal movements of the excavating machine and of the guide structure are adapted so that these movements are independent of each other and so that in particular the machine may move backwards with respect to the structure so as to carry out complementary excavation along this latter,
- the excavation machine is divided into two so as to form in the sea-bed two parallel trenches on each side of the front portion of the piping to be laid and buried and the moldboard provided at the front of the guide structure has the symmetrical shape of a ship's stem for laterally pushing into respectively the first excavated trenches the two halves of the ridge which exists between these two trenches just after their formation,
- in a trenching and pipe-laying device according to the preceding paragraph, the stem of the guide structure is formed from two leaves connected to the front portion of this structure, each leaf ending at its front end in a sharp edge and the two leaves being urged towards one another by forming the towing coupling of the structure by means of a single cable ending in two short rear strands hitched respectively to these two leaves.

The invention comprises, apart from these main arrangements, certain other arrangements which are used preferably at the same time and which will be more explicitly discussed hereafter. In what follows, preferred embodiments of the invention will be described with reference to the accompanying drawings in a way which is of course in no wise limitative.

FIGS. 1,2,3 of these drawings show respectively in a longitudinal vertical section through I—I of FIG. 2, in a top view and a vertical cross section through III—III of FIG. 2, a trenching and pipe-laying device constructed in accordance with the invention.

FIG. 4 is a vertical cross section of FIG. 2 through IV—IV, the trenching and pipe-laying device being removed.

FIG. 5 shows a possible form for the vertical cross section of the guide structure forming part of the above device.

FIGS. 6 and 7 shows schematically in respectively two separate opening states a variable opening stem which may form part of the guide structure.

Generally, it is desired to form a trench and bury therein a pipe laid previously on a sea-bed 2, i.e. to bury this pipe at the bottom of a trench or "ditch" formed in said bed, this trench being closed again after such burying so as to avoid any risk of damage to the piping by anchors, drag nets, dredgers, or similar devices. For this, an excavating machine 3 is provided in a way known per se for forming in bed 2 a first trench 4 which extends parallel to the front section $1_1$ of piping 1 and which is necessarily slightly offset transversely in a plane with respect to this section.

This machine 3 operates in any desirable way depending on the hardness and the cohesion of bed 2.

It may employ for this any of the known dredging or excavation techniques (such as the advance of a moldboard, the emission of high pressure water jets, pumping, cutting, boring . . . ) or even several of these techniques, simultaneously or successively, the machine in question being possibly formed in some cases from several separate machines.

In the embodiments shown schematically, machine 3 works the ground mechanically by means of a bucket chain.

This machine 3 is associated with an apparatus A (not shown) for causing its horizontal movements and formed by a self-propelled device such as a caterpillar tractor adapted for travelling over the sea-bed 2, a surface ship or a winch mounted on a barge.

An inert guide structure or "formwork" 5 is provided for the purpose of burying piping 1 automatically as it advances horizontally along this piping, said advance being ensured by an apparatus B (not shown) which may be formed in one of the ways indicated for apparatus A.

Although they may be combined into a single one, these two apparatus A and B are here preferably separate.

In the case of apparatus A, the self-propelled device may itself carry machine 3.

In all cases, the self-propelled device may be hitched to the assembly to be moved by means of cables, of which the one relative to formwork 5 has been designated in the drawings by reference 6, this cable 6 being hitched to a bollard 7 on said formwork.

The formwork 5 also differs from those known before in that it is not moved simply inside the first trench 4 excavated by machine 3 but parallel to this trench 4 in the horizontal extension of the front piping section $1_1$ inside a second trench 8 formed by its own advance.

Said formwork 5 is preferably, for this purpose, equipped at its front end with an oblique moldboard 9 adapted so that, during its horizontal advance, it pushes the earth back laterally which it engages inside the trench 4 already excavated and contiguous.

In other words, the second trench 8 is excavated at the expense of the first trench 4.

It is the previous existence of this first trench 4, contiguous with formwork 5, which makes it possible to form this second trench 8 by the horizontal advance of said formwork alone, preferably reinforced in front of the moldboard 9, this advance in fact resulting in engaging and causing to collapse into the previously excavated trench 4 one of the sides of this latter which is naturally fragile because it is defined by an unpropped vertical or substantially vertical face.

Since the second trench 8 thus formed is planewise in the extension of the front piping section $1_1$, it is possible to bury piping 1 in this trench without having to deflect it in the plane.

This is an important advantage of the invention which in particular allows relatively rigid piping 1 to be laid and buried such as metal pipes formed from successions of rigid sections connected together.

Slight bending of this piping is required in the longitudinal vertical plane of its main line.

But the corresponding radii of curvature may be very high by giving a great length to formwork 5: this length may in some cases reach or even exceed 100 m, which forms a quite original feature of the invention, since the length of known formworks is less than 5 m.

Any desirable vertical guide surface 10 may be provided for facilitating the formation of this vertical bend and relative sliding of piping 1 along formwork 5.

It may be advantageous to lay piping 1 directly on the sea-bed at 10, a little in front of the inlet opening 11 for this piping in formwork 5: the very weight of the piping thus contributes to shaking the ground which is supports and facilitates the destructive work of moldboard 9.

It can be seen in FIG. 1 that the trenching and pipe-laying may lead to a slight raising of the front section $1_1$ of the piping in front of the formwork, particularly when said piping is flexible.

Such front raising may be facilitated by means not shown such as a crane provided at the front of formwork 5.

With such front raising, formwork 5 may be shortened, but is not indispensable.

The operation of the above described trenching and pipe-laying device is as follows:

Machine 3 begins by excavating the first trench 4 at the side of the front piping section $1_1$ previously laid on the sea-bed 2.

Then formwork 5 is pulled, which has piping 1 passing longitudinally therethrough, so that its moldboard 9 forms the second trench 8 contiguous with trench 4 under piping 1, by pushing the corresponding earth laterally to said trench 4.

The second effect of such pulling is to automatically and progressively bury piping 1 in the second trench 8 thus formed. On leaving formwork 5 at the rear thereof, piping 1 is situated at the bottom of trench 8 and the edges of this latter, no longer being held back by the formwork, may fall back laterally on to this piping for closing said trench. If required, such natural closure of the trench may be assisted by any other desirable means such as towing a second levelling formwork.

The independence between the horizontal movements of machine 3 and formwork 5 is advantageous in that the first one may be moved backwards until it is in line with moldboard 9 or evenfurther back until it is in contact with a side of formwork 5 itself, so as to complete the trenching and to relieve the moldboard or formwork of the local lateral thrusts exerted thereagainst by the ground, which thrusts may ultimately lead to jamming making the advance of the formwork difficult.

It should also be noted that the excavating or "pumping" rate of machine 3 may be modified so as to cause it to remove a volume of excavated material greater—and even very much greater—than that required for forming the first trench, the excess removed being a part of the excavated material pushed theretowards by the advance of the moldboard : this excess may even form the essential part of the excavated materials removed by said excavating machine 3.

In the preferred embodiments, the trenching and pipelaying device is divided in two symmetrically with respect to its median longitudinal plane:

- it comprises two identical excavating machines 3 adapted for forming two first parallel trenches 4,
- and the moldboard 9 provided at the front of formwork 5 has the form of a ship's stem with two oblique faces symmetrical to each other with respect to said plane.

Said formwork 5 is then disposed between the two trenches 4 and the purpose of its moldboard 9 is to dislodge and push laterally towards these two trenches 4 in the direction of arrows F (FIGS. 1,4) the ridge of earth 13 initially located between these trenches, the material forming this ridge being made fragile by the very formation of said trenches which define it.

This symmetrial construction is advantageous not only because the mass of earth to be engaged by moldboard 9 is made more fragile, but also because of the control of the horizontal advance of formwork 5.

In fact, by increasing the relative volume excavated by the right-hand excavating machine 3, the collapse of the ridge of earth 13 towards the right is made easier during advance of moldboard 9, which orientates this moldboard and so formwork 5 towards the right and the same observation is applicable to the leftward orientation.

The respective widths of the first trenches 4 and of the second trenches 8 may be varied within wide limits.

For example, these widths are substantially identical to each other when there is only one trench 4 whereas on the other hand the width of each trench 4 is substantially equal to half of that of trench 8 when two parallel trenches 4 are desired.

But relative values may also be adopted of the order of half or twice those which have just been indicated : in particular, in the case where the excavation or pumping volume of each excavating machine is greater than that required for excavating the first trenches 4, these may be much narrower than the second trench 8 and even, eventually, they may not be completely excavated.

The relative depths of the different trenches may be identical, as in the illustrated embodiment, or on the contrary different.

The height of moldboard 9 may be greater than, equal to or less than (as shown in FIG. 1) the depth of the trench 8 formed by this moldboard.

In so far as the parallel traces, seen in a plane, of the first and second trenches is concerned, they are preferably strictly contiguous as illustrated. But they could also overlap slightly or, on the contrary, be mutually separated by thin strips of earth.

Each active oblique face of moldboard 9 may, as illustrated, be flat and vertical, its "obliqueness" being considered with respect to the horizontal advancing direction of the formwork. But it may also be curved in any desirable way as is shown for moldboards.

In the case of dividing the excavating machine 3 into two, the two identical elementary machines provided for excavating the two first trenches 4 are advantageously locked together by means of a rigid framework (not shown) making the horizontal transverse distance therebetween invariable. Other means (not shown) may also be provided for transversely centering the formwork 5 with respect to each excavating machine.

The formwork 5 is formed essentially by a tunnel whose cross section could have a closed contour but which is preferably open at the bottom, the cross section of this tunnel then having the shape of an upturned U, which straddles piping 1 and fills the second trench 8.

This tunnel is formed from smooth external plating 14 (FIG. 5) reinforced on the inside by transverse frames 15 and longitudinal stiffeners 16, these different elements being preferably made from metal.

The lower ends of the two sidewalls of the tunnel end advantageously in lower sharp edges 17 forming skids sliding over the bottom of trench 8.

If the length of formwork 5 is great, it may be made from several links whose ends fit into each other step by step, the direction of mutual overlapping being chosen so as not to hinder the forward advance of the assembly.

To facilitate positioning of piping 1 inside formwork 5 at the beginning of operations, in the case of a symmetrical construction, its front stem 9 may be formed of an "openable" type ; this stem is for example formed from two leaves $9_1$, $9_2$ (FIGS. 6,7) mounted for pivoting about a vertical shaft 18 provided at the front ends of the sides of formwork 5.

Each leaf terminates at its front end in a sharpened section adapted to be jointingly applied against the section of the other leaf so as to form the closed moldboard 9 (FIG. 7) for forming the second trench 8.

The towing cable 6 for formwork 5 is terminated in this case at its rear end by two relatively short strands $6_1$ and $6_2$ which are hitched respectively to the two leaves at 19 so that the pull exerted on this cable tends to bring the two leaves closer together and to close the stem.

At the beginning of trenching and pipe-laying, formwork 5 is placed astride piping 1 with its front stem open.

The pull exerted on cable 6 causes both the progressive excavation of the second trench 8 and progressive closing of the stem : it may be arranged so that complete closure of this stem is only made possible when said stem is sufficiently buried in the sea-bed to be situated below the piping 1 to be laid and buried as is shown in figure 1.

Following which and whatever embodiment is adopted, a trenching and pipe-laying method is provided whose use is sufficiently clear from the foregoing and which has numerous advantages with respect to the previously known methods, in particular in so far as the following are concerned, efficiency, the possibility of handling relatively rigid pipes and the possibility of easily raising to the surface the only dynamic parts of the device (excavating machines) because these parts are here separated from the inert formwork.

As is evident and as it follows moreover already from what has gone before, the invention is in no wise limited to those of its modes of application and embodiments which have been more especially considered ; it embraces, on the contrary, all variants thereof, particularly:

those in which the front portion of the formwork is not specially provided in the form of a moldboard, the front face of such framework having any desirable convex shape those in which the piping to be laid and buried is not laid previously on the sea-bed but is lowered directly into the formwork from a position disposed in front of this formwork, at an upper level, those in which the formwork is loaded locally, at least temporarily, by ballasting for causing it to penetrate into the sea-bed in response to the pull alone exerted thereon.

I claim:

1. A trenching and pipe-laying method for forming a trench in a sea-bed and burying in the trench a piping previously laid on the sea-bed comprising the steps of:

excavating a first vertical trench extending parallel to and offset in a plane with respect to a front portion of the piping to be laid and buried, excavating, by means of a guided structure advancing horizontally along the piping, a second vertical trench which is parallel to the first vertical trench, which is contiguous and offset in a plane with respect to the first vertical trench and which is extended in a plane in the extension of the front portion of the piping, pushing the materials removed by forming the second trench back laterally into the first vertical trench by means of an oblique moldboard provided at the front of the guide structure, and automatically burying the piping by means of the guide structure in the second trench.

2. A trenching and pipe-laying apparatus for forming a trench in a sea-bed and burying in the trench a piping previously laid on the sea-bed, comprising:

an excavating machine adapted for forming a first vertical trench extending parallel to and offset in a plane with respect to a front portion of the piping to be buried, and a guide structure for automatically burying the piping, said guide structure being adapted for moving parallel to the first vertical trench and for forming automatically during its horizontal advance a second vertical trench parallel to said first vertical trench, contiguous therewith and extending planewise in the extension of said front piping portion, said structure comprising an oblique front moldboard which pushes laterally back into the first trench the earth which said moldboard engages, said guide structure also including a means for automatically burying the piping in the second trench thus formed.

3. The trenching and pipe-laying apparatus according to claim 2, characterized in that the excavating machine (3) is disposed fairly close to the moldboard (9) so as to discharge not only the material removed for forming the first trench (4) but also part of the material pushed back towards this first trench by the guide structure (5).

4. The trenching and pipe-laying apparatus according to 2, characterized in that the horizontal movements of the excavating machine (3) and of the guide structure (5) are independent of each other so that the excavating machine may move back with respect to the structure so as to effect complementary excavations therealong.

5. The trenching and pipe-laying apparatus according to claim 2, characterized in that the excavating machine (3) forms in the sea-bed (2) two parallel first vertical trenches (4) on each side of the front portion of the piping ($1_1$) to be buried and in that the moldboard (9) provided at the front of the guide structure (5) has the symmetrical shape of a ship's stem adapted for pushing back laterally into respectively the two first trenches excavated the two halves of the ridge (13) which exists between these two trenches just after they have been formed.

6. The trenching and pipe-laying apparatus according to claim 5, characterized in that the stem (9) of the guide structure (5) is formed from two leaves ($9_1$, $9_2$) mounted for pivoting about vertical shafts (18) connected to a front portion of the structure, each leaf terminating in a sharp edge at its front end and the two leaves being urged together by forming a towing coupling of the structure from a single cable (6) terminating in two short rear strands ($6_1$, $6_2$) hitched respectively (at 19) to these two leaves.

* * * * *